United States Patent [19]

Ballard

[11] 4,093,215

[45] June 6, 1978

[54] CHANCE OPERATED SIMULATED CARD GAME

[76] Inventor: Chester P. Ballard, 1219-41 Barham Dr., San Marcos, Calif. 92069

[21] Appl. No.: 693,276

[22] Filed: Jun. 4, 1976

[51] Int. Cl.[2] ..... A63F 1/18

[52] U.S. Cl. ..... 273/1 E; 273/138 A

[58] Field of Search ..... 35/8 A, 8 B, 9 C; 273/1 E, 134 A, 136 A, 138 A, 148 R, 149 P, 151; 235/92 GA; 340/323 R, 323 B

[56] References Cited

U.S. PATENT DOCUMENTS

| | | | |
|---|---|---|---|
| 2,023,210 | 12/1935 | Potter | 273/151 |
| 3,529,829 | 9/1970 | Seifert | 273/149 P |
| 3,579,856 | 5/1971 | Way | 273/136 A |
| 3,796,433 | 3/1974 | Fraley et al. | 273/138 A |
| 3,876,208 | 4/1975 | Wachtler et al. | 273/138 A |
| 3,888,491 | 6/1975 | Bernard et al. | 273/136 A |
| 3,889,956 | 6/1975 | Castle | 273/1 E |
| 3,962,800 | 6/1976 | Feldheim | 273/138 A X |

*Primary Examiner*—Richard C. Pinkham
*Assistant Examiner*—Vance Y. Hum
*Attorney, Agent, or Firm*—Brown & Martin

[57] ABSTRACT

A game system is disclosed. A center unit includes a plurality of display devices for indicating cards respectively played by a plurality of individual players, wherein each display device provides display of a given card in response to a predetermined center display code signal. There is a plurality of player hand units. Each player hand unit is coupled to a separate center unit display device. Each player hand unit includes a plurality of display devices for indicating the identity of the cards in an individual player's hand in response to predetermined hand display code signals representing different cards, and switches for selecting a card for display in the center unit display device coupled to that player hand unit. An electronic circuit responds the selection of a card by providing a predetermined center display code signal to the center unit display device coupled to that player hand unit. The system essentially also includes a circuit for randomly distributing a predetermined number of hand display code signals to each player hand unit. A game system adapted for playing contract bridge is specifically described.

4 Claims, 4 Drawing Figures

COMPUTA BRIDGE GAME (MECHANICAL) PLAYER HAND UNIT
1 OF 4 FIG 1
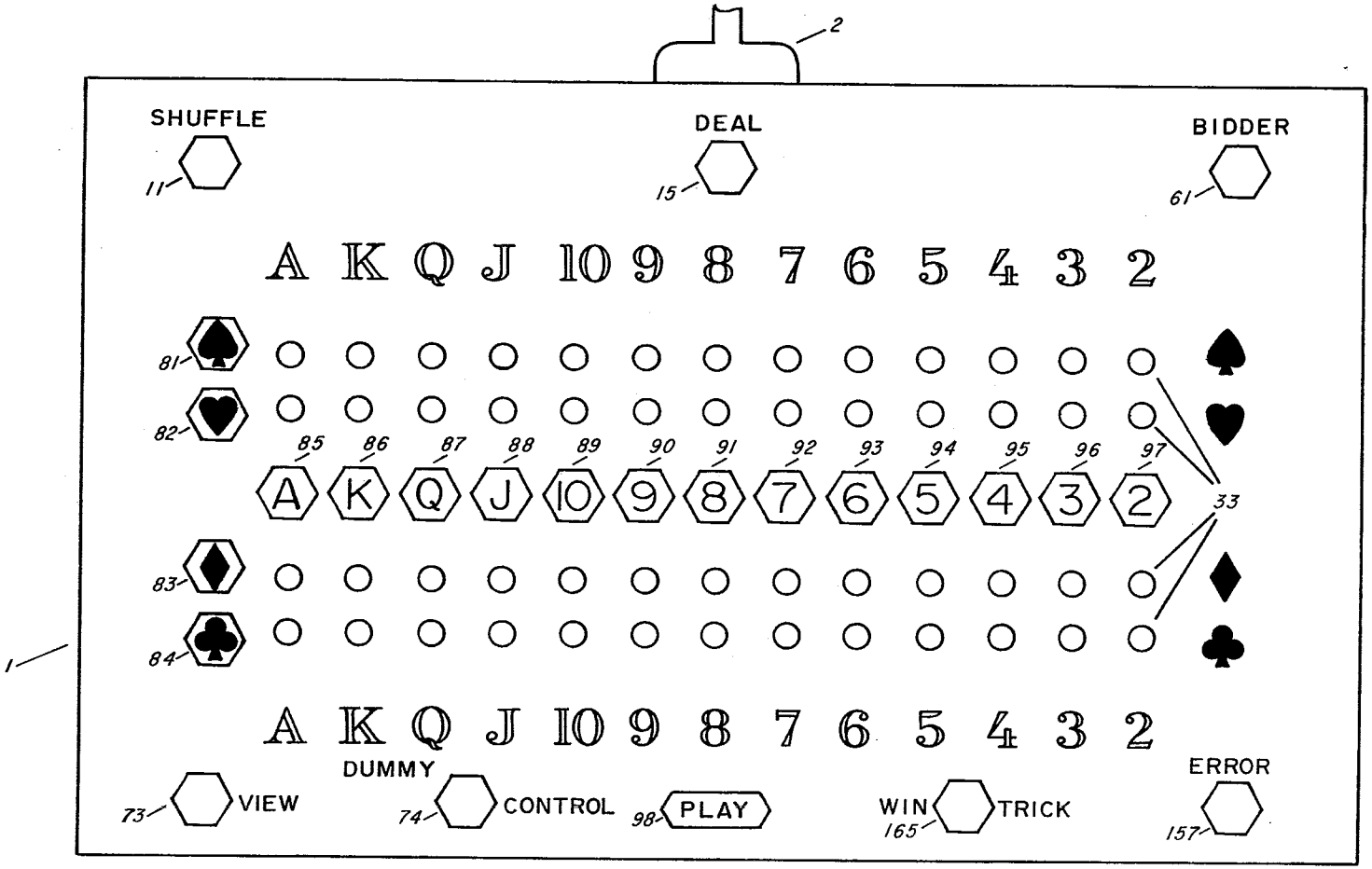

COMPUTA BRIDGE GAME (MECHANICAL) CENTER UNIT FIG 2
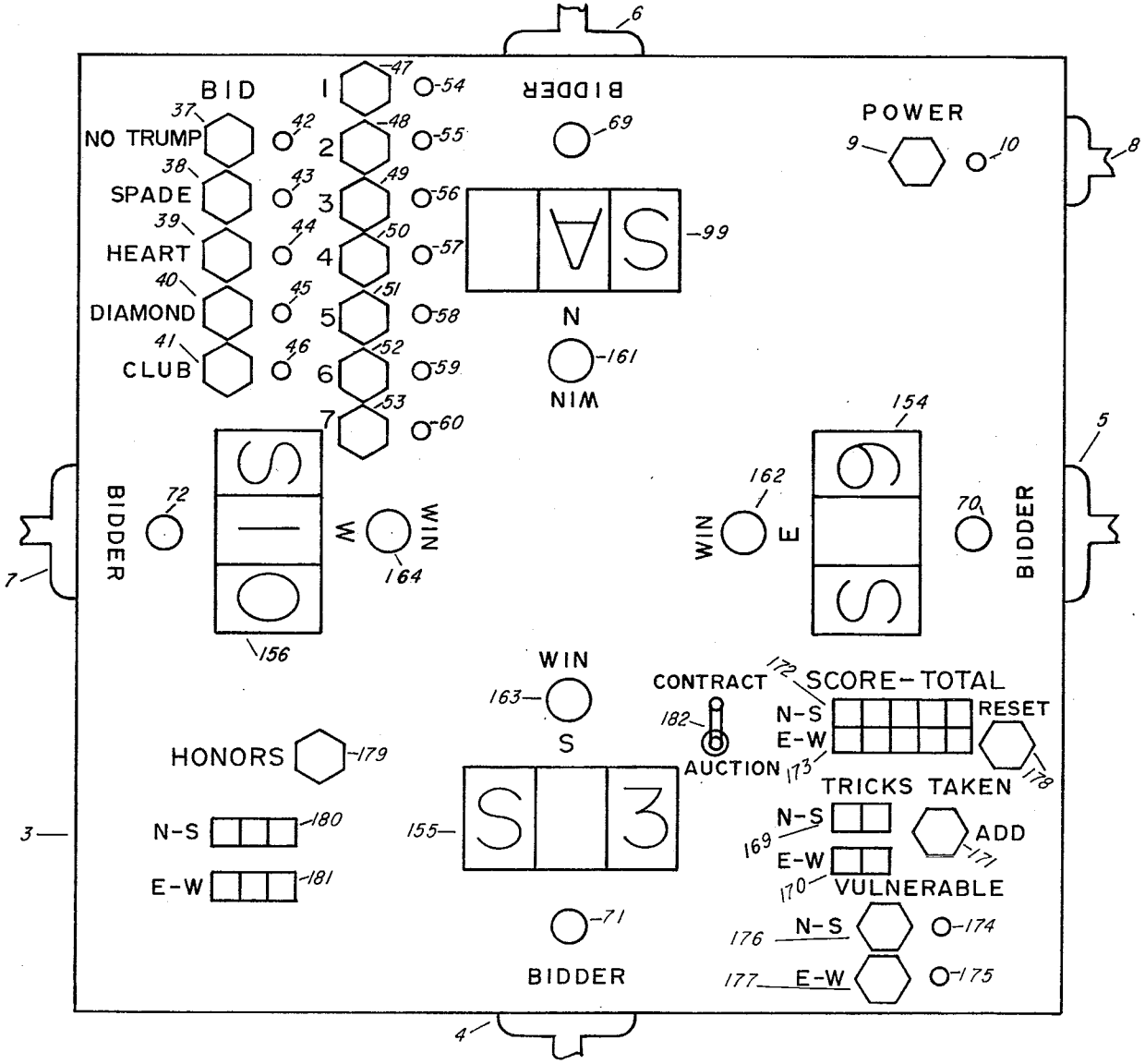

COMPUTA BRIDGE GAME (ELECTRICAL) FIG. 3A
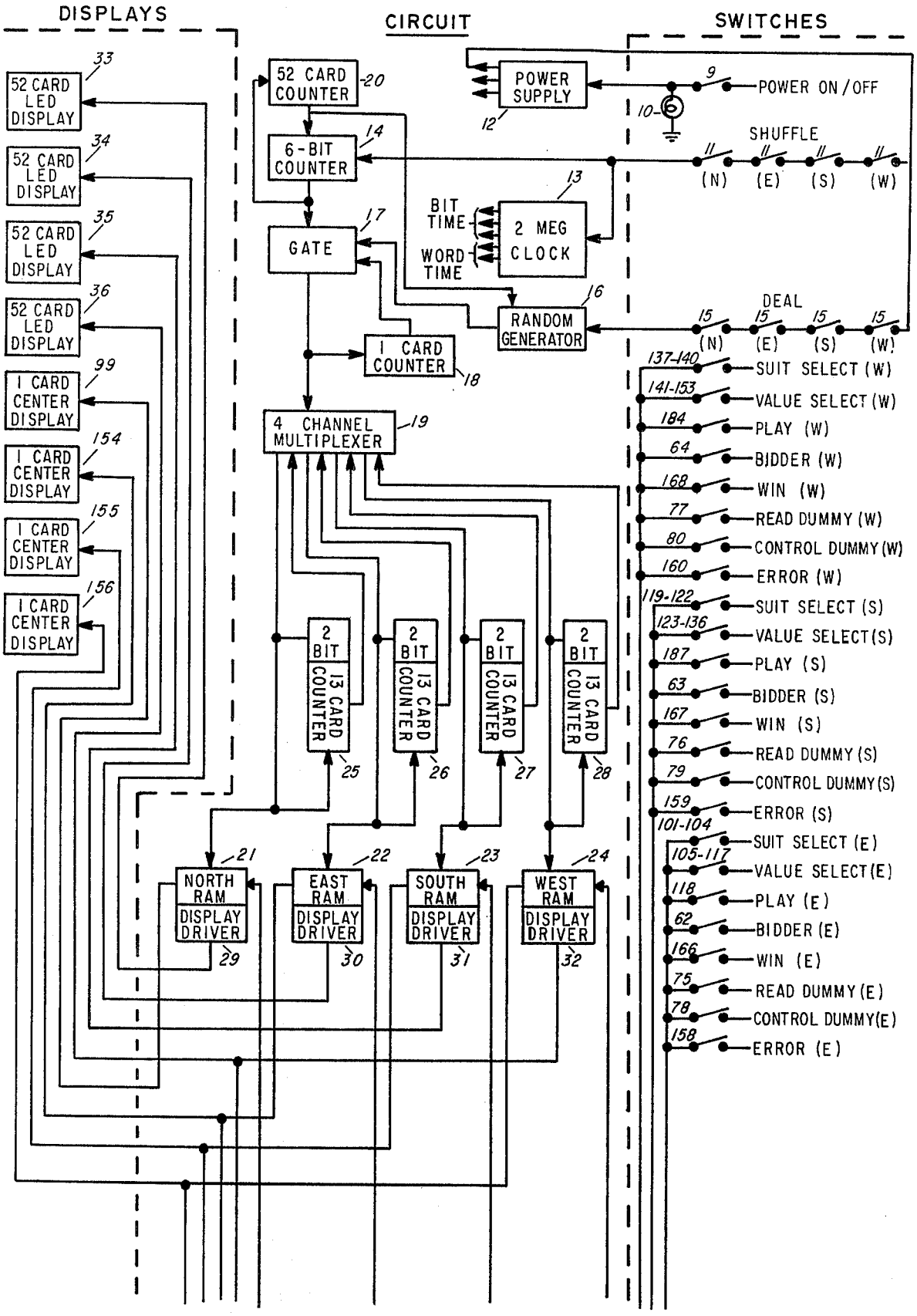

CHANCE OPERATED SIMULATED CARD GAME

BACKGROUND OF THE INVENTION

This invention relates to electronic mechanization of a series of games of chance involving random distribution. More particularly, the invention relates to various card games such as bridge, in its various forms, auction, contract and duplicate; rummy, poker, pinochle as well as bingo, roulette, blackjack and other popular gambling games.

Games have been mechanized in the past, mostly mechanically, as in card decks, roulette tables, etc., some electrically such as U.S. Pat. No. 3,233,340 for Teaching & Game Machine, U.S. Pat. No. 3,854,725 for Electric Chess Game Boards, U.S. Pat. No. 3,671,041 for Electrically Operated Bingo Game Apparatus and U.S. Pat. No. 3,693,975 for Computer Game. These patents were revealed in the patent search for this invention. However, in no known case is there a similarity to the mechanizations in this invention.

One object of this invention is to provide an improvement of significance to the random nature of such games of chance.

Another object of the invention is to eliminate those mechanical actions which can accidently or intentionally alter the element of chance in such games.

SUMMARY OF THE INVENTION

The present invention is an improved game system utilizing electronic circuit technology. The game system of the present invention includes a center unit including a plurality of display devices for indicating cards respectively played by a plurality of individual players, wherein each display device provides display of a given card in response to a predetermined center display code signal; a plurality of player hand units, wherein each player hand unit is coupled to a separate center unit display device, and includes a plurality of display devices for indicating the identity of the cards in an individual players hand in response to predetermined hand display code signals representing different cards, and switches for selecting a card for display in the center unit display device coupled to that player hand unit; a circuit responsive to the selection of a card for providing a predetermined center display code signal to the center unit display device that is coupled to that player hand unit; and a circuit for randomly distributing a predetermined number of hand display code signals to each player hand unit.

The circuit for randomly distributing the hand display code signals to each player hand unit includes a plurality of RAM's, each separately coupled to each of the player hand units, wherein each RAM provides predetermined hand display code signals in response to being addressed by different hand card code signals having different counts; a counter for providing a succession of hand card code signals having different counts; a multiplexer connected to the RAM's for receiving the hand card code signals and distributing the received hand card code signals to separate RAM's; a circuit for randomly providing the hand card code signals from the counter to the multiplexer; and a plurality of card counters, each of which is coupled to the multiplexer and to a given RAM for counting the number of hand card code signals provided to the given RAM and for inhibiting further distribution of hand card code signals to the given RAM upon counting that a predetermined number of hand card code signals have been distributed to the given RAM.

In the context of the present invention, the term "card" may refer not only to a playing card, but also to some other game indicator, such as a bingo number.

Additional features of the present invention are described in the Description of the Preferred Embodiment.

BRIEF DESCRIPTION OF THE DRAWING

FIG. 1 is a plan view of a device that is constructed in accordance with one preferred embodiment of a players hand unit for the play of the game of bridge. This device allows the player to view his cards as dealt to him (and dummy hand after bid) and allows him to play the hand (and dummy hand if bidder), a total system would include four such devices.

FIG. 2 is a plan view of a device that is constructed in accordance with one preferred embodiment of a center unit for the play of the game of bridge. This device allows the player to see his "card" when played and the cards of the other players as they are played. It also has a place to record the bid, to note who is the bidder, to note who is the winner of each trick, what the total number of tricks taken by each side are, the honors per side, who is vulnerable and a place to add the hand score, as well as the total score for each side. This total can be reset and a new game started. Auction or contract may be selected.

FIGS. 3A and 3B in combination show the electrical/electronic design of a preferred embodiment of the game of bridge which illustrates the various techniques to accomplish such games of chance.

DESCRIPTION OF THE PREFERRED EMBODIMENT

Figure 3B:
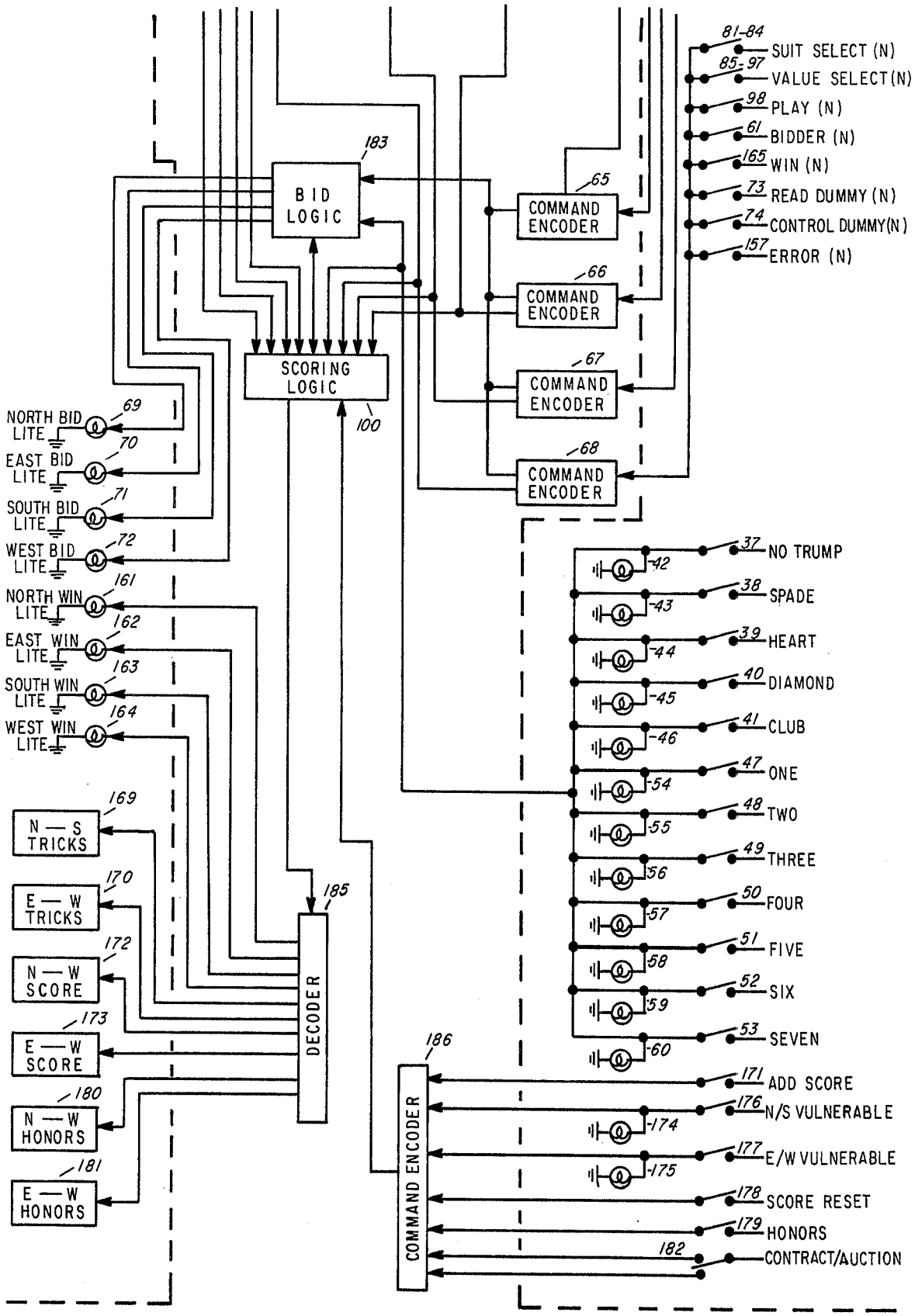

The preferred embodiment for the game of bridge shown in the figures is shown by way of illustration only. Referring now to the Drawing, in FIG. 1, a player hand unit 1 is a box mae of plastic, for example, that has a faced tilted at an angle to permit the player's hand to be viewed by him alone. The various switches and displays are noted and cross referenced in the discussion of the electrical circuit, FIGS. 3A and 3B. That portion of the electrical/electronic circuit unique to each players hand is mounted within the box. A connector 2 with suitable wire cable is used to connect each player's hand box 1 to the center unit 3 (FIG. 2).

Reference is made to FIG. 2. A center unit which is made from plastic, for example, is a simple square box housing the central unique electrical/electronic switches, displays and parts used in the play of the game of bridge which will be discussed in detail and cross reference in the explanation of FIGS. 3A and 3B. Electrical connectors 4, 5, 6, 7 permit each of the four player hand units 1 to be connected to the center unit 3. Connector 8 provides power to operate the unit 3 on regular household current. Internal batteries can also be provided and used in portable situations.

The four player hand units are each connected to the center unit 3 by the connectors and cables 4, 5, 6, 7 provided and the center unit 3 is connected to the available power source (if used). Now referring to FIGS. 3A and 3B, switch 9 is actuated causing power to be applied and causing lamp 10 to light indicating power on and unit ready for play.

Each player momentarily actuates the shuffle switch 11 on his panel. This applies power from the power supply 12 to the clock (bit and word time) 13 which operates at a frequency of approximately 2 megacycle bit time and 250KHz word rate (8 bit), or more, dependent upon the components chosen in mechanizing the system. Power is also provided to the 6 bit counter 14 which outputs a 6 bit card identifier in an 8 bit word time.

Each player then momentarily actuates the deal switch 15 thereby applying power to a random generator 16, which in this embodiment is a noise diode doped, for example, to yield an average of 20 pulses per second, thus dealing a deck of 52 cards in slightly more than approximately two and one half seconds. The output of the random generator 16 is fed to the gate 17 for controlling the 6 bit counter. The gate 17 in turn is closed and reset by the one card counter 18 after the passage of 6 bits representing a single card to the input of the four channel multiplexer 19. A 52 card counter 20 senses the output of the 6 bit counter 14 and shuts down the counter and random generator 16 after a total of 52 cards for bridge have been delivered to the multiplexer 19.

For other games this counter 20 would be set to a different quantity such as 48 for pinochle, 53 for poker, etc.. In another embodiment a ROM (Read Only Memory) having the requistie number of cards could be substituted for the 6 bit counter 14 and the 52 card counter 20. For card games such as Rummy, roulette, bingo, blackjack, poker, etc. a circulating register operating at clock speed with gates, hand opened by each player action, could be substituted for the random generator 16 and the multiplexer 19 to achieve a high order of randomness or chance.

The high speed multiplexer 19 accepts each word as it comes from the gate 17 passing it by the input of the four RAMs (Random Access Memory) 21, 22, 23, 24 representing the four players respective hands for Bridge at a rate of 62.5 thousand times (approximately) each second. This rate gives an exceedingly high rate of randomness or chance. This rate, of course, can be made higher or lower or variable by choice of component values.

The output of each channel of the multiplexer 19 is monitored by the four 13 card counters 25, 26, 27, 28, each of which also adds a 2 bit hand identifier. When having sensed that the 13 cards making up a bridge hand have passed a card counter 25, 26, 27, 28 will close the output of that multiplexer 19 channel. The six-bit card code plus 2 bit hand identifier code will also be the address (eight-bit code) to the RAMs 21, 22, 23, 24 with each of the RAMs 21, 22, 23, 24 being able to accept any hand card code for display.

The 13 channel counters 25, 26, 27, 28 can be changed or reset for other games such as pinochle, etc..

The display decoder/drivers 29, 30, 31, 32 will respond to predetermined hand display code signals from the RAM's 21, 22, 23, 24 to provide the power to the LED (Light Emitting Diode) lights 33, 34, 35, 36 for showing each player his separate cards.

The RAM 21, 22, 23, 24 could be replaced by a ROM or RAM especially filled with a duplicate bridge hand for the play of duplicate or tourney bridge. Teaching could also be accomplished by using special ROMs or RAMs in lieu of the RAM's 21, 22, 23, 24. With each player having a view of his hand bidding can now proceed in the normal manner.

After the bidding is completed the bidder will actuate the proper trump switch 37, 38, 39, 40, 41 to light the proper lamps 42, 43, 44, 45, 46 and to set the logic in bid logic circuit 183. Also the bid value switch 47, 48, 49, 50, 51, 52, 53 is actuated to light the proper light 54, 55, 56, 57, 58, 59, 60, and to set the bid logic circuit 183. These operate through an 8 bit command encoder 186 and decoder 185 located in the center unit 3.

The player making the bid will then actuate the bid switch 61, 62, 63, 64 on his console, FIG. 1, thereby feeding a signal thru the appropriate common encoder 65, 66, 67, 68 to the bid logic circuit 183, and lighting the proper bid light 69 or 70 or 71 or 72. Actuation of the bid switch 61 on the bidders console 1 will also unlock the dummy view switch 73 and dummy control switch 74 (FIG. 1). At the same time the other console dummy view switches (read dummy) 75, 76, 77 will be unlocked. However the other dummy control switches 78, 79, 80 will not. Actuation of the dummy view switches 73, 75, 76, 77 will cause lights in that console to blink at a slow rate thus allowing the other three players to read the dummy hand. Should a player prefer, he can request the player who was playing dummy to rotate his console so it may be seen without the necessity of actuating his view switch 73, 75, 76, 77. Control of dummy is released to bidder and play can start in the normal manner.

The player to the left of the bidder will initiate play by actuation of a suit switch 81, 82, 83, 84 (for North player) and a value switch 85 through 97. Play switch 98 will then be actuated to transfer the card to proper center display 99 and to be sensed by scoring logic circuit 100. The center display 99 provides display of a given card in response to a predetermined center display code signal in accordance with the address provided by a display card code signal received from a command encoder 68 in response to the actuation of switches 81 through 84, 85 through 97, and 98. Similar switches 137 - 140, 141 - 153, 184; 119 - 122, 123 - 126, 187; 101 - 104, 105 - 117, 118 on the other consoles will allow the bidder to play dummy's card; and then the other player and then the bidder play their chosen card. Each card played appears sequentially in the proper center display 99 - 154, 155, 156 and is sensed by the scoring logic circuit 100.

Should a player actuate a trump switch and or a value switch in error he can actuate the error switch 157, 158, 159, 160 prior to actuating the play switch and restart. If he transfers the display of his card to the center unit 3 prior to discovering the error he can actuate the error switch 157 - 160 and return it to his display, as in regular cards. Of course, other players will know that it is in his hand.

As each card is played, the scoring logic circuit 100 will sense the card; and if it is the trick winning card the win light 161, 162, 163, 164 will be lighted. Actuation of the win switch 165, 166, 167, 168 on the console corresponding to the light that is lit will clear the center displays 99 - 154 - 155 - 156 and turn off win lights 161, 162, 163, 164, as well as add a count to the proper trick dislay 169, 170.

When all cards have been played the scoring logic circuit 100 assesses the bid logic circuit 183 and the tricks taken by each team and upon actuation of the add score switch 171, will compute the scores and display them in center displays 172, 173; and a new hand can start upon initiation of shuffle switches 11.

Should either team be vulnerable as shown by lights 174, 175, which are actuated by switches 176, 177, the scoring logic circuit 100 will also assess and compute the score based on such vulnerability.

Actuation of switch 178 will reset the score to zero upon completion of the hands and allow a new game to start.

Honors are scored by actuating the Honors switch 179 located in the center unit 3 and reading the results in the two displays N-S 180 and E-W 181 also located in the center unit 3. This switch 179, is actuated after bidder switch 61, 62, 63, 64 and prior to initiation of first play. The scoring logic circuit 100 will assess each players hand and record results in the appropriate display 180, 181. When an add score switch 171 is actuated the scoring logic circuit 100 will add honors to play score and display the total in display 172, 173.

A two-position switch 182 is provided to set the scoring logic circuit 100 for the play of either Contract or Auction type bridge.

Simpler versions of the system can be made, where for instance only the shuffle, deal and play and an account of tricks taken are included. The bid/score features could readily be left to the players. Also provisions for duplicate or contact/auction options could be eliminated.

Utilizing micro-circuit technology, it is demonstrated that with P-channel, N-channel and complimentary MOS (Metal oxide on silicon) devices including random generators, such as doped diodes, together with suitable displays of LED (light emitting diodes) and liquid crystals, economical card games such as bridge, rummy, poker, pinochle, etc. can be mechanized for sale and use having greater utility, convenience, ease and a higher degree of random distribution, unaffected by human manipulation, accidental or otherwise than the standard games employing conventional card decks. Utilizing the same devices games of chance, such as slot machines, bingo, roulette, blackjack, etc., can be mechanized to have the feature of randomness unaffected by human manipulation, accidental or otherwise, thereby giving a higher degree of confidence in the users, both commercial and consumer. Adult and children parlour games of chance can also be mechanized for fun and amusement.

I claim:

1. A game system, comprising:

a center unit including a plurality of display devices for indicating cards respectively played by a plurality of individual players, wherein each display device provides display of a given card in response to a predetermined center display code signal;

a plurality of player hand units, wherein each player hand unit is coupled to a separate center unit display device, and includes a plurality of display device for indicating the identity of the cards in an individual player's hand in response to predetermined hand display code signals representing different cards, and switch means for selecting a card for display in the center unit display device coupled to said player hand unit;

means responsive to said selection of a card for providing a said predetermined center display code signal to the center unit display device coupled to said player hand unit; and means for randomly distributing a predetermined number of said hand display code signals to each player hand unit; wherein the distributing means comprise a plurality of RAM's, each separately coupled to each of the player hand units, wherein each RAM provides said predetermined hand display code signals in response to being addressed by different hand card code signals having different counts;

a counter for providing a succession of hand card code signals having different counts;

a multiplexer connected to the RAM's for receiving said hand card code signals and distributing said received hand card code signals to separate RAM's;

means for randomly providing said hand card code signals from the counter to the multiplexer; and a plurality of card counters each of which is coupled to the multiplexer and to a given RAM for counting the number of hand card code signals provided to said given RAM and for inhibiting further distribution of said hand card code signals to said given RAM upon counting that a predetermined number of hand card code signals have been distributed to said given RAM.

2. A game system according to claim 1, wherein the means for randomly providing hand card code signals from the counter to the multiplexer, comprises a gate for providing a said hand card code signal to the multiplexer in response to a gate signal, and a random signal generator for randomly providing said gate signal to the gate.

3. A game system according to claim 2, further comprising, a second card counter coupled to the first mentioned counter and the random generator for counting the number of hand card code signals provided by the first counter and for shutting down the first counter and the random generator when a predetermined number of hand card code signals have been provided.

4. A game system according to claim 1, further comprising a second card counter coupled to the first mentioned counter for counting the number of hand card code signals provided by the first counter and for shutting down the first counter when a predetermined number of hand card code signals have been provided.

* * * * *